US005814247A

United States Patent [19]

Derule et al.

[11] Patent Number: 5,814,247

[45] Date of Patent: Sep. 29, 1998

[54] AQUEOUS SOLUTION FOR THE COLD-WORKING TREATMENT OF STEEL SHEET

[75] Inventors: Hervé Derule, Metz; Valérie Bour Beucler, Marco En Baroeuil; Jean Steinmetz, Laxou, all of France

[73] Assignee: Sollac, Puteaux, France

[21] Appl. No.: 760,671

[22] Filed: Dec. 9, 1996

[30] Foreign Application Priority Data

Dec. 7, 1995 [FR] France ..... 95 14440

[51] Int. Cl.[6] ..... C23F 11/167

[52] U.S. Cl. ..... 252/396; 252/392; 106/14.13; 106/14.05

[58] Field of Search ..... 252/396, 392; 106/14.13, 14.05

[56] References Cited

U.S. PATENT DOCUMENTS

| | | | |
|---|---|---|---|
| 3,220,233 | 11/1965 | Thomsen et al. . | |
| 4,687,634 | 8/1987 | Baseman | 422/7 |
| 5,348,575 | 9/1994 | Muller et al. | 106/14.35 |
| 5,507,861 | 4/1996 | Caupin et al. | 106/14.13 |
| 5,650,097 | 7/1997 | Wysong et al. | 252/392 |

FOREIGN PATENT DOCUMENTS

| | | |
|---|---|---|
| A-556087 | 8/1993 | European Pat. Off. . |
| 493 711 | 6/1950 | France . |

*Primary Examiner*—James H. Reamer
*Attorney, Agent, or Firm*—Oblon, Spivak, McClelland, Maier & Neustadt, P.C.

[57] ABSTRACT

According to the invention, the solution contains a water-soluble salt of heptanoic acid and an oxidizing agent and, preferably, a wetting agent.

By virtue of the combination of these compounds, low concentrations are sufficient to obtain satisfactory corrosion protection, which makes it possible to maintain a nonfatty surface appearance (on the treated sheet) and facilitates the treatment of the solution effluent (or that of the subsequent degreasing effluent).

8 Claims, No Drawings

AQUEOUS SOLUTION FOR THE COLD-WORKING TREATMENT OF STEEL SHEET

FIELD OF THE INVENTION

The invention relates to the wet cold-working of steel sheet.

By cold-working of sheet is meant the working of a sheet especially for compressing it or for deforming it.

Thus, for example after a rolling operation, a steel sheet is generally subjected to recrystallization annealing and then to cold-working.

Here the object of the cold-working is to improve the mechanical properties and the flatness of the sheet and to impart a predetermined rugosity to its surface.

This cold-working is generally carried out continuously by passing, with moderate compression of the sheet, between two rolls.

The cold-working step may be carried out wet, that is to say by spraying a cold-working treatment solution.

The cold-working treatment solution is generally sprayed onto both sides of the sheet in the region of the roll bite.

After wet cold-working, the sheet is generally dried, then possibly oiled and, in the case of sheet in strip form, coiled.

Since cold-working treatment solutions, which are generally aqueous, risk corroding the sheet, corrosion inhibitors are added to these solutions.

These inhibitors must be effective with respect to the risks of corrosion arising from the residual salinity on the surface of the sheet.

They must also remain effective during prolonged storage, for example with respect to traces of water which may persist between the laps of a coiled sheet-metal strip.

It may therefore be seen that the performance characteristics of these inhibitors must be quite special.

In particular, these inhibitors must also be suitable for withstanding atmospheric corrosion, which is different from corrosion in an immersed environment, and for withstanding the high pressures of cold-working.

PRIOR ART

The corrosion inhibitors commonly used for this application are based on nitrites or on organic substances such as amine borates.

The function of these inhibitors is:

- in the case of nitrites, to block the surface reactivity, thereby limiting the dissolution of steel by forming a passivating layer of iron oxide;
- in the case of organic substances, to react with the surface in order to form protective stable compounds.

Because of the presence of this type of corrosion inhibitor in these treatment solutions, the cold-working effluent is particularly difficult and expensive to treat.

In the case of nitrites, it is not possible to remove them from the effluent using conventional treatments, such as those used to treat effluent flowing from rolling plants, which are generally flocculation treatments.

However, the environmental standards relating to discharges fix nitrite concentration ceilings which are not to be exceeded.

Meeting these standards therefore necessitates either giving up using nitrite-based solutions or opting for a particularly expensive treatment process.

In the case of organic substances, especially those based on amine borates, the effectiveness of the conventional effluent treatment processes is not in general sufficient to remove the organic carbon contained in said effluent below the permissible ceilings.

These inhibitors may have other drawbacks—unpleasant smells, public health risks (dermatoses, carcinogenic risks, etc.).

SUMMARY OF THE INVENTION

The object of the invention is to provide an aqueous treatment solution for the cold-working of steel sheet offering satisfactory corrosion protection, including atmospheric corrosion, not representing any special danger and generating effluent which is easy and economical to treat.

By satisfactory corrosion protection is meant protection at least equivalent to that obtained with those conventional solutions of the prior art commonly used for this application.

By effluent economical to treat is meant effluent which can be treated conventionally, especially using a conventional rolling-effluent treatment process, while at the same time meeting the permissible discharge standards in force.

The advantage of using this type of conventional process is obviously particularly advantageous when a rolling-effluent treatment plant exists on the same industrial site.

Other fields exist where it is advisable to use cold-working solutions containing corrosion inhibitors, for example that for the manufacture of welded pipes.

For the manufacture of welded steel pipes, the process starts with steel sheet slit to a width corresponding to the diameter of the pipes to be manufactured, then a tubular cylindrical shell is formed by successive indenting and forming passes of the sheet between rollers, the shell thus formed is then seam welded in order to close it and then, after possible final profiling and gauging, the pipe is cut to length and the cut pipes bundled together.

Throughout these successive transformations, it is necessary to spray the sheet using a cold-working fluid making it possible, especially, to cool the sheet or the pipe (as well as the rolls of the plant).

The cold-working of the sheet is therefore also carried out in a wet medium and atmospheric corrosion problems also arise, especially when storing the pipes (in bundles), especially at the points of contact of the pipes with each other in the same bundle.

As previously, cold-working solutions providing corrosion protection are therefore used, such as, for example, aqueous oil emulsions.

One drawback of these cold-working solutions is that pipes with a fatty surface are obtained and that it is then necessary to degrease them if it is desired, for example, to paint them or coat them.

Degreasing these pipes is an expensive operation and the degreasing effluent, which contains the corrosion inhibitor from the cold-working solution, must also be treated.

The object of the invention is therefore to provide an aqueous treatment solution for the cold-working of steel sheet providing satisfactory corrosion protection, without giving a fatty appearance and making it possible to save on the degreasing operation, especially in the case of coating or painting.

Nevertheless, should degreasing be necessary, one of the objectives of the invention is then that the degreasing effluent should be easy to treat.

The subject of the invention is an aqueous solution for the wet cold-working treatment of steel sheet, characterized in that it contains a water-soluble salt of heptanoic acid and an oxidizing agent.

Soluble salts of heptanoic acid, as inhibitor compounds for metallic corrosion in an immersed environment, especially in cooling circuits, are already known.

However, it is observed that, according to the invention, an aqueous solution of salts of heptanoic acid may also be used as a cold-working solution, because these salts resist the high pressures of cold-working and also provide resistance to atmospheric corrosion.

Furthermore, by virtue of the presence of an oxidizing agent, a solution providing excellent corrosion resistance, including resistance to atmospheric corrosion, is obtained even with low concentrations of the water-soluble salt of heptanoic acid.

By virtue of this low concentration of inhibitor (the water-soluble salt of heptanoic acid), the sheet treated by this solution does not exhibit a fatty appearance and it is often not even necessary to degrease it for subsequent operations, for example for coating or for painting.

Still by virtue of this low concentration of inhibitor in the cold-working solution, the effluents from this solution (or the degreasing effluents from this inhibitor) are easier to treat.

The effluent treatment is further facilitated because of the biodegradable nature of the salts of heptanoic acid.

Even when an oxidizing agent such as nitrites is used, it is used in the solution at much lower concentrations than in those solutions of the prior art based on nitrites, and the concentration of nitrites in the effluent does not exceed the allowed discharge ceiling.

Another advantage of the invention is that these solutions represent no risk with respect to public health.

The invention may also have one or more of the following characteristics:

- the pH of said solution is between 8.5 and 9.5;
- the molar concentration of said water-soluble salt is less than or equal to $5\times10^{-2}$ mol per liter;
- said cold-working solution contains a wetting agent;
- in the presence of a wetting agent, the molar concentration of said water-soluble salt is less than or equal to $2\times10^{-2}$ mol per liter;
- the molar concentration of oxidizing agent is between approximately 0.1 and approximately 1 times the molar concentration of said water-soluble salt;
- said salt of heptanoic acid is a salt of an alkali metal or an alkaline-earth metal, preferably a sodium salt;
- said oxidizing agent is chosen from nitrites and perborates.

DESCRIPTION OF THE PREFERRED EMBODIMENTS

The invention will be better understood on reading the description which will follow, given by way of example.

The example which follows relates to the cold-working of sheet leaving a rolling plant.

The cold-working device is of a conventional type and comprises two superposed cold-working rolls and the path of travel of the sheet-metal strip to undergo cold-working is approximately horizontal and passes between the rolls.

In the region of the roll bite, on the path of travel, the device includes spray nozzles for uniformly spraying the top and bottom surfaces of a travelling strip.

These spray nozzles are connected by pumps to a tank of aqueous cold-working treatment solution.

The cold-working device also includes means for recovering the treatment solution which are arranged beneath the travel path and are connected to a station for treating and purifying the waste water.

In the treatment solution tank, an aqueous solution is prepared which, according to the invention, contains sodium heptanoate as the water-soluble salt of heptanoic acid and sodium perborate as the oxidizing agent.

Preferably, the pH of the solution is adjusted to a value close to 9, for example by adding sodium hydroxide.

The concentrations of sodium heptanoate and sodium perborate, which remain as low as possible while at the same time allowing the required corrosion protection performance characteristics to be achieved, are determined by prior tests in the laboratory.

These prior tests are not described here in detail, but may be derived from the procedures described in the examples hereinbelow.

Preferably, the molar concentration of sodium heptanoate is less than or equal to $5\times10^{-2}$ mol per liter; in practice, this concentration will generally be greater than $10^{-3}$ mol/liter.

Preferably, the molar concentration of sodium perborate is approximately less than or equal to the molar concentration of sodium heptanoate; in practice, this concentration will generally be greater than or equal to approximately one tenth of this concentration.

Using the wet cold-working device, the continuous cold-working of a sheet-steel strip is carried out conventionally by spraying the top and bottom surfaces of the strip with the treatment solution according to the invention.

By virtue of the simultaneous presence of the salt of heptanoic acid and of the oxidizing agent in the cold-working solution, sufficient corrosion protection is obtained even with low concentrations of the salt of heptanoic acid and of the oxidizing agent, which makes it possible to treat the effluent from said solution easily and economically.

In order to treat this effluent, the same treatment plants as those for rolling plants may especially be used.

Other salts of heptanoic acid and other oxidizing agents may be used without departing from the present invention.

Thus, in the case of the use of nitrites as oxidizing agent, the effluent from the solutions according to the invention is easier to treat than the nitrite-based solutions of the prior art.

This is because, even without removing the nitrites from the effluent, their concentration, by virtue of the invention, can remain below the permissible threshold without special treatment.

This nitrite concentration remains much less in the solutions according to the invention than in the nitrite-based solutions of the prior art, the "nitrite" oxidizing agent being present in the invention only synergistically with the salt of heptanoic acid in order to obtain the required corrosion-inhibiting properties at low concentration.

It is therefore much easier, in the case of the solutions according to the invention, to meet the environmental standards regarding the discharging of nitrites, without additional special treatment.

According to an advantageous variant of the invention, a wetting agent is added to the cold-working solution according to the invention.

Preferably, the wetting agent is of the nonionic type; its concentration is approximately 0.1%.

It is possible, especially, to use, as wetting agent, a product marketed by WITCO under the brand name PA 9017 or a product marketed by HENKEL under the name MAGNUSPRAY (a wetting agent from the group of polyethoxylated alcohols).

The function of the wetting agent is to spread the treatment solution uniformly over the surface of the sheet in order to obtain a protective and passivating layer of constant thickness.

Surprisingly, the presence of a wetting agent in the cold-working solution according to the invention makes it possible to decrease further the concentrations of the salt of heptanoic acid and of the oxidizing agent which are sufficient to obtain a satisfactory corrosion resistance, thereby making it possible to treat the effluent even more easily and economically.

Preferably, the molar concentration of sodium heptanoate will then be less than or equal to $2\times10^{-2}$ mol per liter.

These wetting agents are particularly advantageous when it is intended to oil the sheet subsequently in order to give it longer-term corrosion protection: this is because this type of wetting agent does not interfere with any subsequent spreading of the oil film.

Finally, if necessary, antifoaming substances may be added to the treatment solution in order to limit the formation of foam during cold-working.

It is possible to use the cold-working solution according to the invention in other sheet cold-working operations, especially for the manufacture of welded pipes.

The solution according to the invention has been used successfully for the manufacture of pipes from steel sheet, especially sheet made of "black" steel, as-pickled or as-cold-rolled steel or aluminum-treated steel.

The pH of the cold-working solution may be adapted depending on the type of steel coating.

After manufacture, the pipes obtained do not have a fatty appearance and may be painted without prior degreasing.

The pipes stored in bundles exhibit very good corrosion resistance (even at the area of contact between the pipes within the same bundle).

The following examples illustrate the invention and the prior laboratory tests which make it possible to determine the optimum concentrations of the salt of heptanoic acid and of the oxidizing agent in an aqueous cold-working treatment solution according to the invention.

EXAMPLE 1

The purpose of this example is to illustrate the ease with which the effluent from the cold-working treatment solutions according to the invention may be treated compared to those of cold-working solutions of the prior art.

In order to evaluate the effectiveness of an effluent treatment process, the difference in "total organic carbon" (denoted hereafter by TOC) contained in the effluent upstream and downstream of a conventional effluent treatment is measured.

In the case of tests for the effectiveness of an effluent treatment, an aluminum salt called WAC from ATOCHEM is used.

This product generally has the effect of flocculating highly diluted compounds present in the effluent by entraining part of the carbon contained in a solid phase which is easily separated.

This product is used conventionally to treat rolling-plant effluent, which plant is often found upstream of the cold-working plants.

The ease of effluent treatment, or "treatability", is then evaluated in the following manner:

- a solution whose composition corresponds to a cold-working effluent is prepared;
- the "total organic carbon" in this solution is measured: the result represents the "TOC" before treatment;
- some WAC product is introduced into the solution and the solution is stirred for 10 seconds; a floc appears which is left to decant;
- next, the "total organic carbon" of the supernatant solution is measured: the result represents the aftertreatment TOC;
- the effectiveness of the treatment is calculated as per the formula:

$$1-(TOC_{after\ treatment}/TOC_{before\ treatment}),\ \text{expressed in } \%.$$

The following table illustrates the treatability of two types of effluent:

1) Effluent coming from a cold-working solution of the prior art (Sol./prior art), based on organic substances: a 1% solution of the product Biocool RC324/A from CRODA;
2) Effluent from a solution according to the invention (Sol.invention)

Effluent "treatability"

| Solution tested | Effectiveness |
|---|---|
| Sol. prior art | 52% |
| Sol. invention | 74% |

By virtue of the invention, the effluent treatability is therefore appreciably improved (in this case by more than 40%).

Moreover, in a general way, by optimizing the concentrations of the salt of heptanoic acid and of the oxidizing agent in the solutions according to the invention, it is possible, in general, to obtain cold-working effluent which contains much less organic carbon (about 45% less) than the effluent from solutions of the prior art.

This cold-working effluent may then be generally treated in the same plants as rolling effluent.

EXAMPLE 2

The purpose of this example is to illustrate the corrosion protection performance of treatment solutions according to the invention containing sodium heptanoate (denoted by NaC7) and an oxidizing agent (sodium perborate—$NaBO_2$, $H_2O_2$, $3H_2O$, which is denoted by "Ox1").

Solutions with various concentrations are prepared and their pH adapted to approximately 9.

The following table (series No. 1) indicates the level of corrosion resistance obtained with these solutions as a function of the molar concentration of NaC7 (row) and of Ox1 (column) expressed in mol/liter.

The results appearing in this table are obtained as indicated hereinbelow.

Series No. 1: sodium heptanoate+oxidizing agent according to the invention.

| NaC7: O × 1 | 0 | $10^{-4}$ | $10^{-3}$ | $5 \times 10^{-3}$ | $10^{-2}$ | $5 \times 10^{-2}$ | $10^{-1}$ |
|---|---|---|---|---|---|---|---|
| | | 4 | 3 | 3 | 300 | 400 | 230 |
| 0 | | P | P | P | B | B | B |
| | 4 | 4 | 230 | | 590 | | |
| $10^{-4}$ | P | P | B | B | B | B | B |
| | 3 | 3 | 210 | | 340 | | |
| $5 \times 10^{-4}$ | p | P | B | B | B | B | B |
| | 6 | 4 | 230 | 150 | 500 | | |
| $10^{-3}$ | P | P | B | B | B | B | B |
| | 4 | 2 | 3 | | | | |
| $5 \times 10^{-3}$ | P | P | P | B | B | B | B |
| | 6 | 2 | 1 | 2 | | | 250 |
| $10^{-2}$ | P | P | P | P | B | B | B |
| | 4 | | | | | 3 | |
| $10^{-1}$ | P | | | | | P | |

In order to evaluate the level of corrosion resistance, the procedure is as follows:

steel specimens are dipped into these solutions and, with these specimens acting as electrodes, the passivation resistance, denoted by $R_p$, is measured (cf. numerical results expressed in ohms in the table: series No. 1);

next, after immersion for two hours, the surface appearance of the specimen is evaluated visually: B means that the electrode is intact after 2 hours and P means that the electrode is pinholed in the table—series No. 1.

According to the invention, comparable corrosion resistances are obtained in the following two cases:

a solution containing at least $10^{-2}$ mol/liter of sodium heptanoate, without any other additive;

a solution according to the invention containing less than $10^{-2}$ mol/liter, especially only $10^{-3}$ mol/liter, of sodium heptanoate but in the presence of an oxidizing agent at a concentration of between $10^{-4}$ mol/liter and the molar concentration of sodium heptanoate.

The presence of an oxidizing agent in the solution according to the invention makes it possible to reduce very significantly the necessary concentration of corrosion inhibitor, in this case sodium heptanoate.

Moreover, it should be pointed out that, in order to obtain satisfactory corrosion protection, the molar concentration of oxidizing agent must remain less than or equal to the molar concentration of corrosion inhibitor, in this case sodium heptanoate.

In practice, a molar concentration of oxidizing agent of only approximately one tenth of that of the corrosion inhibitor may suffice.

According to this corrosion test, which is not specific to the intended application, the corrosion protection is satisfactory as soon as the molar concentration of heptanoate exceeds $10^{-3}$ molar and as soon as the molar concentration of perborate exceeds $10^{-4}$molar.

Since, by virtue of the presence of an oxidizing agent, it is possible to use cold-working solutions which are less concentrated in organic inhibitor, such as sodium heptanoate, the "total organic carbon" is accordingly decreased in the effluent, which makes it easier to treat it.

EXAMPLE 3

The purpose of this example is to illustrate the corrosion protection performance characteristics of the cold-working treatment solutions according to the invention compared to those of solutions of the prior art, especially those based on nitrites or on organic substances such as amine borates, under conditions approaching those of the intended application.

All the solutions according to the invention have a pH of approximately 9, obtained as required by additions of sodium hydroxide.

NaC7 denotes sodium heptanoate.

100 mm×100 mm sheet-steel specimens, a series of cold-working treatment solutions to be tested and a series of corrosive sodium sulfate solutions at various concentrations are prepared.

The procedure for the corrosion resistance test is as follows:

the face of a sheet specimen is partly wetted by a drop of the treatment solution to be tested and a drop of corrosive solution;

next, stacked on the same face is another sheet specimen which is applied against the previous one with a constant predetermined force;

the stack is maintained for three days in the atmosphere;

after dismantling the stack, the sheet specimens are dried and any traces of corrosion on parts of the faces which were wetted are visually assessed; the assessments are classified according to 3 categories: R: generalized rust; P: rust pinholes; B: well-protected surface exhibiting neither pinholes nor rust.

Given below are the corrosion resistance results for various types of cold-working treatment solutions, according to the invention or otherwise, these being differentiated mainly by the nature of the corrosion inhibitor used.

Comparative series No. 1: sodium nitrite.

Comparative series No. 1: sodium nitrite.

| Corrosive S. | Treatment solution: sodium nitrite (g/l) | | | | |
|---|---|---|---|---|---|
| $Na_2SO_4$, g/l | 0.0 g/l | 2.5 g/l | 3.0 g/l | 5.0 g/l | 6.5 g/l |
| 0.0 g/l | R | R | P | B | B |
| 0.5 g/l | R | R | p | B | B |
| 5.0 g/l | R | R | R | R | R |

Comparative series No. 2: organic liquid of the prior art.

The liquid used here is marketed under the reference N272 by QUAKER; it contains, especially, amine borate.

| Corrosive sol. | "Organic" treatment sol.: diluted quantity (g/l) | | | |
|---|---|---|---|---|
| $Na_2SO_4$, g/l | 0.5 | 1.5 | 3 | 5 |
| 0.0 g/l | B | B | B | B |
| 0.5 g/l | B | B | B | B |
| 5.0 g/l | R | R | R | R |

Comparative series No. 3: nitrite-containing liquid according to the prior art.

The liquid used here is marketed under the reference 508DR by QUAKER; it contains especially nitrites.

| Corrosive sol. | "Nitrite-based" treatment sol., diluted quantity (g/l) | | | |
|---|---|---|---|---|
| $Na_2SO_4$, g/l | 0.5 | 1.5 | 3 | 5 |
| 0.0 g/l | B | B | B | B |
| 0.5 g/l | B | B | B | B |
| 5.0 g/l | R | B | B | B |

Series No. 2: sodium heptanoate+oxidizing agent according to the invention.

The oxidizing agent employed is sodium perborate, denoted by "Ox1" hereinbelow.

All the concentrations are expressed in g/l.

| | NaC7: | | | | |
|---|---|---|---|---|---|
| | 1.40 | 4.50 | 6.80 | 11.20 | 15.40 |
| | | | Ox1: | | |
| $Na_2SO_4$ | 0.14 | 0.45 | 0.70 | 1.20 | 1.60 |
| 0.0 | R | B | B | B | B |
| 0.5 | R | R | B | B | B |
| 5.0 | R | R | R | B | B |

It may be deduced from this that a concentration of about 0.05 mol/liter of sodium heptanoate is sufficient to obtain, according to the test of Example 3, satisfactory corrosion protection when the concentration of oxidizing agent (Ox1) is about 1/10 of that of the sodium heptanoate (the molar masses of sodium heptanoate and sodium perborate are respectively 152 g and 154 g).

EXAMPLE 4

This example is intended to illustrate the implementation of the invention, especially when a wetting agent is added to the previously described solutions of sodium heptanoate and of oxidizing agent.

The oxidizing agent employed here for the test is a sodium nitrite, denoted hereafter by "Ox2".

The corrosion tests are carried out and presented as in Example 3.

Series No. 3: sodium heptanoate+oxidizing agent according to the invention.

| Corrosive sol. | Treatment s.: g/l of NaC7/g/l of $Ox_2$ | | |
|---|---|---|---|
| $Na_2SO_4$, g/l | 1/3 | 3/3 | 5/3 |
| 0 g/l | B | B | B |
| 0.5 g/l | P | B | B |
| 3 g/l | P | R | R |
| 5 g/l | R | R | R |

Series No. 4: sodium heptanoate+oxidizing agent+wetting agent, according to the invention.

0.1% by weight of a nonionic wetting agent known commercially as PA 9017, from WITCO, is added to the solutions to be tested.

| Corrosive Sol. | Treatment s.: g/l of NaC7/g/l of Ox2 | | |
|---|---|---|---|
| $Na_2SO_4$, g/l | 1/3 | 3/3 | 5/3 |
| 0 g/l | B | B | B |
| 0.5 g/l | B | B | B |
| 3 g/l | P | R | B |
| 5 g/l | R | R | B |

By comparing the results of series No. 3 with series No. 4, it may be observed that there is a marked improvement in the corrosion resistance to highly corrosive solutions (3 g/l and 5 g/l of $Na_2SO_4$ lines), this improvement being provided by the wetting agent.

Conversely, the presence of a wetting agent makes it possible to further decrease the concentrations of the salt of heptanoic acid and of oxidizing agent which are necessary to obtain both satisfactory corrosion protection and effluent which is easy and economical to treat.

According to these results, the necessary concentrations could be divided by approximately three compared to those of solutions without a wetting agent.

Thus, by extrapolating the conclusion from Example 3, which concluded with a sufficient concentration of about 0.05 mol/liter of the salt of heptanoic acid in a solution without a wetting agent (but with an oxidizing agent), a sufficient corrosion resistance could even be obtained with a concentration of only 0.02 mol/liter of the salt of heptanoic acid in a solution with a wetting agent (and still with an oxidizing agent).

One of the main purposes of the invention is to obtain the best anti-corrosion protection with the minimum carbon content in the solution effluent (or in the degreasing effluent; therefore, heptanoic acid salt, oxidizing agent and wetting agent concentrations should be chosen in accordance with this purpose.

With regard to the invention oxidizing agent, what seems to be important is to oxidize small quantities of iron ($FE^{\circ} \rightarrow Fe^{2+}$, preferably $Fe^{3+}$) which are able to complex with the carboxylic ion of the heptanoic salt; formation of such a complex is thought to be a condition which provides good and efficient protection.

Other oxidizing agents include chromates or molybdates, but they are not preferred as they would cause pollution problems. Hydrogen peroxide ($H_2O_2$) or even oxygen ($O_2$) dissolved in water can also be used. When steel sheet is rolled to form a coil, the problem may occur that there is not enough oxygen between the superposed sheets in a coil to improve efficiency of the protection and it is thus preferred to use an oxidizing agent more concentrated and more efficient than oxygen. The oxidizing agent counter ion (e.g., nitrite, perborate, chromate, molybdate, etc.) is not limited and includes metals (alkali, alkaline, etc.) and other species.

French patent application 95 14440 is incorporated herein by reference.

We claim:

1. An aqueous solution comprising less than or equal to $2\times10^{-2}$ mol/liter of a water-soluble salt of heptanoic acid, an oxidizing agent, and a wetting agent, wherein the molar concentration of the oxidizing agent is 0.1–1 times the molar concentration of said water-soluble salt of heptanoic acid.

2. The solution as claimed in claim 1, wherein the pH of said solution is between 8.5 and 9.5.

3. The solution as claimed in claim 1, wherein said water-soluble salt of heptanoic acid is an alkali metal salt or an alkaline-earth metal salt.

4. The solution as claimed in claim 1, wherein said water-soluble salt of heptanoic is the sodium salt of heptanoic acid.

5. The solution as claimed in claim 1, wherein said oxidizing agent is a nitrite.

6. The solution as claimed in claim 1, wherein said oxidizing agent is a perborate.

7. The solution as claimed in claim 1, wherein said wetting agent is a polyethoxylated alcohol.

8. The solution as claimed in claim 1, wherein said wetting agent is nonionic.

* * * * *